US007821190B2

(12) United States Patent
Date et al.

(10) Patent No.: US 7,821,190 B2
(45) Date of Patent: Oct. 26, 2010

(54) IMAGE DISPLAY APPARATUS AND MANUFACTURING METHOD THEREOF

(75) Inventors: Takashi Date, Machida (JP); Kaoru Koiwa, Tokyo (JP); Takahiro Oguchi, Sagamihara (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 615 days.

(21) Appl. No.: 11/844,136

(22) Filed: Aug. 23, 2007

(65) Prior Publication Data

US 2008/0054786 A1 Mar. 6, 2008

(30) Foreign Application Priority Data

Aug. 25, 2006 (JP) ..... 2006-229664

(51) Int. Cl.
*H01J 1/62* (2006.01)

(52) U.S. Cl. ..... 313/495; 445/24; 428/605

(58) Field of Classification Search ..... 313/495–497; 445/24–25

See application file for complete search history.

(56) References Cited

U.S. PATENT DOCUMENTS

| | | | | |
|---|---|---|---|---|
| 6,800,995 | B2 * | 10/2004 | Ohnishi | 313/495 |
| 7,088,036 | B2 | 8/2006 | Kanda et al. | 313/495 |
| 2003/0102798 | A1 * | 6/2003 | Ohnishi | 313/495 |
| 2004/0018375 | A1 * | 1/2004 | Banno et al. | 428/605 |
| 2006/0192479 | A1 | 8/2006 | Kanda et al. | 313/495 |
| 2007/0080624 | A1 * | 4/2007 | Koiwa et al. | 313/495 |
| 2007/0126338 | A1 * | 6/2007 | Koiwa et al. | 313/495 |

FOREIGN PATENT DOCUMENTS

| | | | |
|---|---|---|---|
| EP | 1 379 118 | | 1/2004 |
| JP | 2001-023547 | A | 1/2001 |
| JP | 2002-270117 | A | 9/2002 |
| JP | 2002270117 | A * | 9/2002 |
| JP | 2003-229079 | A | 8/2003 |
| JP | 2006-196760 | | 7/2006 |

OTHER PUBLICATIONS

Engish Translation of JP2002-270117, published Sep. 20, 2002.*
European Search Report dated Jul. 29, 2009, in related corresponding European Patent Appln. No. 07114850.6.

* cited by examiner

*Primary Examiner*—Mariceli Santiago
*Assistant Examiner*—Mary Ellen Bowman
(74) *Attorney, Agent, or Firm*—Fitzpatrick, Cella, Harper & Scinto

(57) ABSTRACT

An image display apparatus includes a display unit including a substrate having an outer surface and an image display area, a conductive layer disposed on the substrate via an adhesive layer, and a conductive tape disposed on the outer surface of the substrate. In addition, a member holds the conductive layer against the substrate. Part of the adhesive layer is layered between the conductive tape and at least a part of the conductive layer, with the conductive tape including a projection portion contacting the conductive layer such that the conductive layer and the conductive tape are electrically connected. The member sandwiches the conductive layer, the conductive tape having the projection portion, and the display unit, and the conductive tape is a ground potential.

8 Claims, 5 Drawing Sheets

IMAGE DISPLAY APPARATUS AND MANUFACTURING METHOD THEREOF

BACKGROUND OF THE INVENTION

1. Field of the Invention

The present invention relates to an image display apparatus and a manufacturing method thereof.

2. Description of the Related Art

As an image display apparatus, a cathode-ray tube (a Braun tube) and a flat panel display (FPD) have been known. As a flat panel display (FPD), a liquid crystal display (LCD), an EL (electroluminescent) display (ELD), a plasma-display panel (PDP), and a field emission display (FED) or the like are available. In the field emission display (FED), an electron-emitting device emits an electron beam to a light-emitting member such as a fluorescence substance so as to emit a light. Therefore, it can be said that the field emission display is an electron beam display that is the same as the cathode-ray tube.

In Japanese Patent Application Laid-Open Publication Nos. 2002-270117, 2001-023547, and 2003-229079 (U.S. Pat. No. 6,800,995), it is disclosed that a transparent conductive layer is provided on a surface (an image display area) at the side of a viewer in order to prevent dust from being attached on that surface. Further, such a conductive layer is typically defined to be a ground potential according to a method for connecting the conductive layer to a metal portion of a steel case to involve or fix the display panel or the like.

SUMMARY OF THE INVENTION

The above-described conductive layer is disposed on a translucent base substance (for example, a base film made of a PET or the like) and this base substance is laminated on the surface of a display unit (an image display area or an image display surface) via a cohesive adhesive layer. Thus, the conductive layer is disposed on the surface (the image display area or the image display surface) of the display unit. In some cases, without using the base substance, the conductive layer may be disposed on the surface (the image display area or the image display surface) of the display unit via the adhesive layer. In addition, various functional layers such as an anti-fouling layer made of a fluorine resin or the like and an optical filter layer or the like may be layered on the translucent base substance (or the conductive layer).

In order to obtain an excellent display image for a long period, it is necessary to reliably control a potential of the conductive layer, however, the conductive layer is a thin film. Therefore, in consideration of the case that various functional layers are disposed or the like, it is difficult to reliably connect the conductive layer to a ground. However, even for a reliable electric connection between the conductive layer and the ground, adopting a complicated configuration increases cost.

Therefore, an object of the present invention is to provide an image display apparatus that can reliably, simply, and electrically connect a conductive layer to a ground and a manufacturing method thereof.

The image display apparatus according to the present invention is provided with at least a display unit including a substrate having an outer surface provided with an image display area; and a conductive layer that is disposed on the substrate via an adhesive layer. An electrode that is disposed on at least a part of the area except for the image display area on the outer surface of the substrate and at least a part of the conductive layer are layered via a part of the adhesive layer; and the conductive layer and the electrode are electrically connected.

According to the present invention, it is possible to provide an image display apparatus that can reliably, simply, and electrically connect a conductive layer to a ground.

Further features of the present invention will become apparent from the following description of exemplary embodiments with reference to the attached drawings.

DESCRIPTION OF THE EMBODIMENTS

Figure 1:
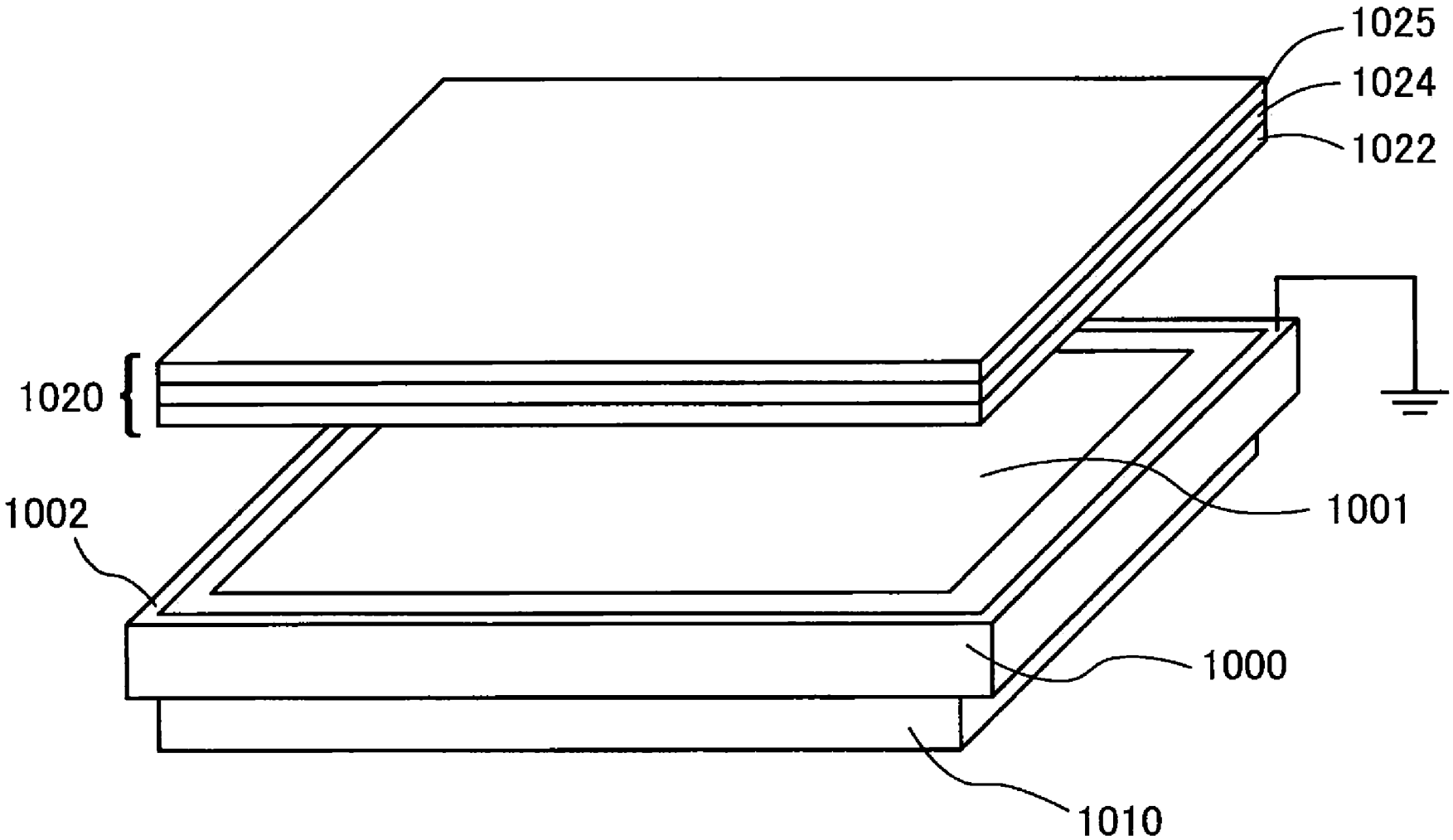
FIG. 1 is a perspective view paternally showing an image display apparatus according to a first embodiment of the present invention.

Preferred embodiments of the present invention will be described in detail below with reference to the drawings. Further, in all the drawings referred in the following embodiments, the same or the corresponding parts are given the same reference numerals.

Further, according to the following embodiment(s), an example using an electron beam display as a display unit is described. However, the present invention can be preferably applied not only to an electron beam display but also to a liquid crystal display (LCD), an EL (electro-luminescent) display (ELD), and a plasma-display panel (PDP).

In addition, as an electron-emitting device used for the electron beam display, an example of using a surface conduction electron-emitting device will be described. The surface conduction electron-emitting device is composed of a conductive film provided with a gap and a pair of electrodes connected to the opposite ends of this conductive film. For the present invention, an electron-emitting device such as a field emission type electron-emitting device and a metal-insulator-metal type electron-emitting device of the like can be used.

First Embodiment

An image display apparatus according to the first embodiment of the present invention will be described with reference to FIG. 1 and FIG. 2. FIG. 1 is a perspective view paternally showing an image display apparatus according to a first embodiment of the present invention, and FIG. 2 is a cross sectional pattern diagram of a part (an end) of the image display apparatus according to the first embodiment of the present invention.

As shown in FIG. 1, the image display apparatus according to the present embodiment is provided with at least a display unit (display panel) 1000 and a film 1020. A driving circuit 1010 is connected to the display unit 1000. For convenience of the explanation, FIG. 1 shows the display unit 1000 and the film 1020 being separated. However, as shown in FIG. 2, the film 1020 is bonded on an image display area 1001 via an adhesive layer 1021 so as to cover at least the image display area 1001 of the display unit 1000 in practice.

Figure 2:
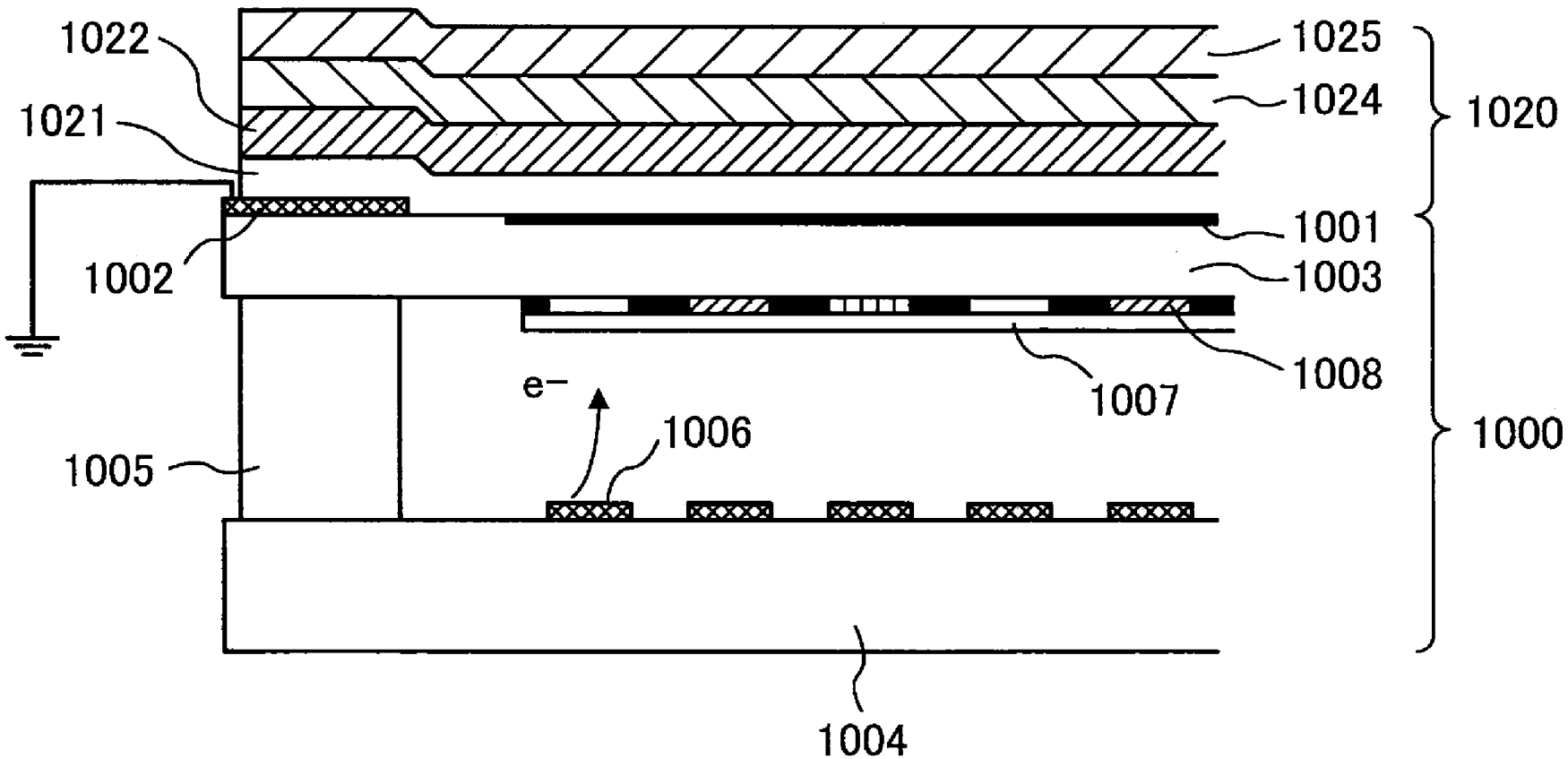
FIG. 2 is a cross sectional pattern diagram of a part (an end) of the image display apparatus according to the first embodiment of the present invention.

As the present embodiment, in the case that the display unit 1000 is a flat panel display unit, as a part of the cross sectional view shown in FIG. 2, the display unit is provided with at least a first substrate 1004 and a second substrate 1003 that are opposed with each other. The above-described image display area 1001 is a part of the outer surface (the surface at the side of air) of the second substrate 1003. According to the present embodiment, an example of using the electron beam display in the flat panel display as the display unit 1000 is described. On the periphery portion that is external from the image display area 1001 of the display unit on the outer surface (the surface at the side of air) of the second substrate 1003, an electrode 1002 to be connected to the ground is disposed.

In order to hold a space between the first substrate 1004 and the second substrate 1003 or/and seal an interior space between the first substrate 1004 and the second substrate 1003, the display unit 1000 may be provided with a frame 1005. The frame 1005 may be made of the same material as the substrates 1003 and 1004 or it may be made of other material.

The viewer of the image display apparatus sees a light (an image) penetrating through the image display area 1001 of the second substance 1003 through a film 1020. Therefore, the second substrate 1003 is made of a transparent material, for example, glass or plastic, and the second substrate 1003 is preferably made of a glass plate. It is preferable that the first substrate 1004 is made of the same material as the second substrate 1003. The electrode 1002 is disposed on a part of the area except for the image display area 1001 on the outer surface of the second substrate 1003. As described above, the electrode 1002 according to the present embodiment is disposed on the outer surface of the second substrate 1003 so as to encircle the image display area 1001 on the outer surface of the second substrate 1003. As shown in FIG. 1, the electrode 1002 is preferably formed so as to completely encircle the image display area 1001, however, such a formation is not necessarily required. In other words, the electrode 1002 may be disposed on a part of the area except for the image display area 1001 on the outer surface of the second substrate 1003.

The image display area 1001 is defined as an area where an image is displayed in the range that is a part of the outer surface of the second substrate 1003 and can be checked by eyes. In addition, it is also possible to define the image display area 1001 as a range when a light emission layer 1008 to be described later is orthogonally projected on the surface of the second substrate 1003.

If the distance between the first substrate 1004 and the second substrate 1003 is small, the frame 1005 can be made of an adhesive material that can block (seal) the interior part of the display unit 1000 (the space between the first substrate 1004 and the second substrate 1003) from the outer space. In addition, if the distance between the first substrate 1004 and the second substrate 1003 is large, the frame 1005 can be made of glass. In such a case, the frame 1005 is adhered to the first substrate 1004 and the second substrate 1003 by the above-described adhesive agent. As an adhesive agent, a low melting glass such as a frit glass and a low melting metal such as indium and an indium alloy.

According to the present embodiment, as the electrode 1002, a conductive tape is used, and the conductive tape is attached so as to encircle the image display area 1001. Then, the conductive tape 1002 is defined as a ground potential by being connected to a case (not illustrated) which supports or involves the image display apparatus. Here, although an example that the electrode 1002 is formed by the conductive tape is described, it is also possible to form the electrode 1002 on the second substrate 1003 by using a publicly-known film formation method such as a spatter method. In addition, according to the present embodiment, with respect to the arrangement position of the electrode 1002, an example that the electrode 1002 is disposed so as to encircle the image display area 1001 is shown, however, the electrode 1002 may be disposed only on a part of the outside of the image display area 1001. However, if the image display area 1001 is larger, the potential of a conductive film 1022 on the part separated from the electrode 1002 is increased, so that it is preferable that the image display area 1001 is disposed so as to encircle the image display area 1001.

In addition, as shown in FIG. 2, according to the present embodiment, in the configuration of the film 1020, the film 1020 is disposed so that a part of the electrode 1002 is covered and other parts of the electrode 1002 are exposed, and connecting a wire to the exposed part, a potential is applied (supplied) to the electrode 1002. Due to such a configuration, it is possible to easily establish an electric connection between the electrode 1002 and the wire. However, if a potential can be applied (supplied) to the electrode 1002, the surface of the electrode 1002 can be entirely covered with the film 1020.

The electron beam display unit 1000 according to the present embodiment may emit electrons from an electron emitting device 1006 by operating the driving circuit 1010 (refer to FIG. 1). Then, by applying a high voltage to a metal back 1007 made of a conductive film or the like, electrons collide with the light emission layer 1008 made of a fluorescence substance or the like so as to emit a light. Accordingly, such an electron beam display unit 1000 may generate (charge) a potential resulting from the high potential of the metal back 1007 at least on the image display area 1001 when displaying an image. In other words, on the surface of the side of air of the second substrate 1003, a potential resulting from the high potential of the metal back 1007 is generated. This tendency is also applied to a cathode-ray tube and a field emission display. Therefore, during driving of the image display apparatus provided with the electron beam display unit 1000 or just after termination of driving, a problem such that air dusts are attached to the image display area 1001 to be accumulated there is caused. Further, charging of the image display area 1001 is frequently generated in the electron beam display unit 1000 and further, charging thereof is generated in other type display unit due to various reasons not a little.

Therefore, as shown in FIG. 2, in the image display apparatus according to the present invention, the functional film 1020 is disposed so as to cover at least the image display area 1001 of the display unit 1000. The potential of the conductive film 1022 configuring the functional film 1020 is typically defined to be a ground potential via the electrode 1002. The electrode 1002 is disposed at the external part of the image display area 1001 of the display unit 1000 (a part of the area except for the image display area 1001 of the second substrate 1003). Therefore, the present image display apparatus is configured so that the electrode 1002 is sandwiched between the conductive layer 1022 and the second substrate 1003 of the display unit 1000. According to the constitution of the present invention, the adhesive layer 1021 is disposed between the electrode 1002 and the conductive layer 1022, so that the conductive layer 1022 and the electrode 1002 can stick together, and an electric connection can be established simply and reliably. In other words, at least a part of the electrode 1002 and a part of the conductive layer 1022 are layered via the adhesive layer 1021. The adhesive layer 1021 is so thin although the details are not clear, so that it may be considered that the conductive layer 1022 and the electrode 1002 are electrically and substantially connected due to a tunnel effect or the like.

The film 1020 is provided with at least the conductive layer 1022. The conductive layer 1022 can provide a function for preventing static charge and/or a function for shielding an electromagnetic wave to the display face of the display unit 1000. According to the examples shown in FIG. 1 and FIG. 2, the functional film 1020 is configured in such a manner that the conductive layer 1022, the base material 1024, and an antireflection layer 1025 are layered in the order from the side of the display unit 1000. However, the film 1020 can be provided with a layer having a different function from the anti-charging function. For example, a hard coat layer in order to prevent damage from being given on the image display area 1001 and an antifouling layer in order to prevent the image display area 1001 from being tainted. The hard coat layer can be obtained, for example, according to a method of using an acrylic cross-linking that is obtained from, for example, (meta)acrylic acid and a pentaerythritol or the like and a method of applying a resin material such as a silicon system and an epoxy system and then, thermally curing them. Further, an optical processing layer for controlling a color property of the displayed image and an antireflection layer for preventing reflection and reception of outside light on the displayed surface or the like may be provided. It is preferable that the antifouling layer is disposed on the most outer surface of the film, and for example, the antifouling layer can be formed by using a coating agent containing a perfluoro group based on a silicon resin.

It is preferable that the adhesive layer 1021 is substantially transparent. The adhesive layer 1021 can be made of various materials, and for example, a rubber adhesive material, an acrylic adhesive material, a silicon adhesive material, and a vinyl adhesive material can be used as a material. In the image display apparatus that has been finally formed, a film such as the conductive layer 1022 is disposed on the image display area of the display unit 1000 via the adhesive layer 1021. Therefore, the adhesive layer 1021 can be recognized as configuring a part of the functional film 1020 or it can be recognized as a different layer from the functional film 1020. In a manufacturing process of the image display apparatus, it is preferable to adopt a simple method of giving the adhesive layer 1021 to the film 1020 and applying this film on at least image display area 1001 of the display unit 1000. Therefore, in such a manufacturing process, the film 1020 is provided with the adhesive layer 1021.

Further, as the base material 1024 shown in FIG. 1 and FIG. 2, a transparent resin layer can be used. As a material for making a transparent resin layer, for example, a polyester resin, a polypropylene resin, an ethylene-vinyl acetate copolymer, polyethylene, polystyrene, and polyurethane or the like can be used. By using the base material 1024, it is possible to give rigidity to the film to some extent, so that the film 1020 can be applied to the display unit 1000 more easily. However, this base material 1024 may be omitted.

According to the constitution of the present embodiment, defining a sheet resistance of the adhesive layer 1021 as $10^{11}\Omega/\square$, a thickness thereof as 20 μm, and a sheet resistance of the conductive layer 1022 as $10^{7}\Omega/\square$, a voltage of 12 kV is applied to the metal back. In this case, the potential of the most outer surface of the functional film 1020 can be a ground potential (0V) substantially when this potential is approximately stabilized. It is obvious that the resistance of the adhesive layer 1021, the thickness of the adhesive layer 1021, and the resistance of the conductive layer 1022 or the like can be accordingly selected not only depending on a numeric value of the present embodiment but also depending on the maximum allowable reaching potential of the surface, a relaxation time till the potential of the most outer surface are stabilized, or the like.

Second Embodiment

Next, the image display apparatus according to a second embodiment of the present invention will be described.

Figure 3:
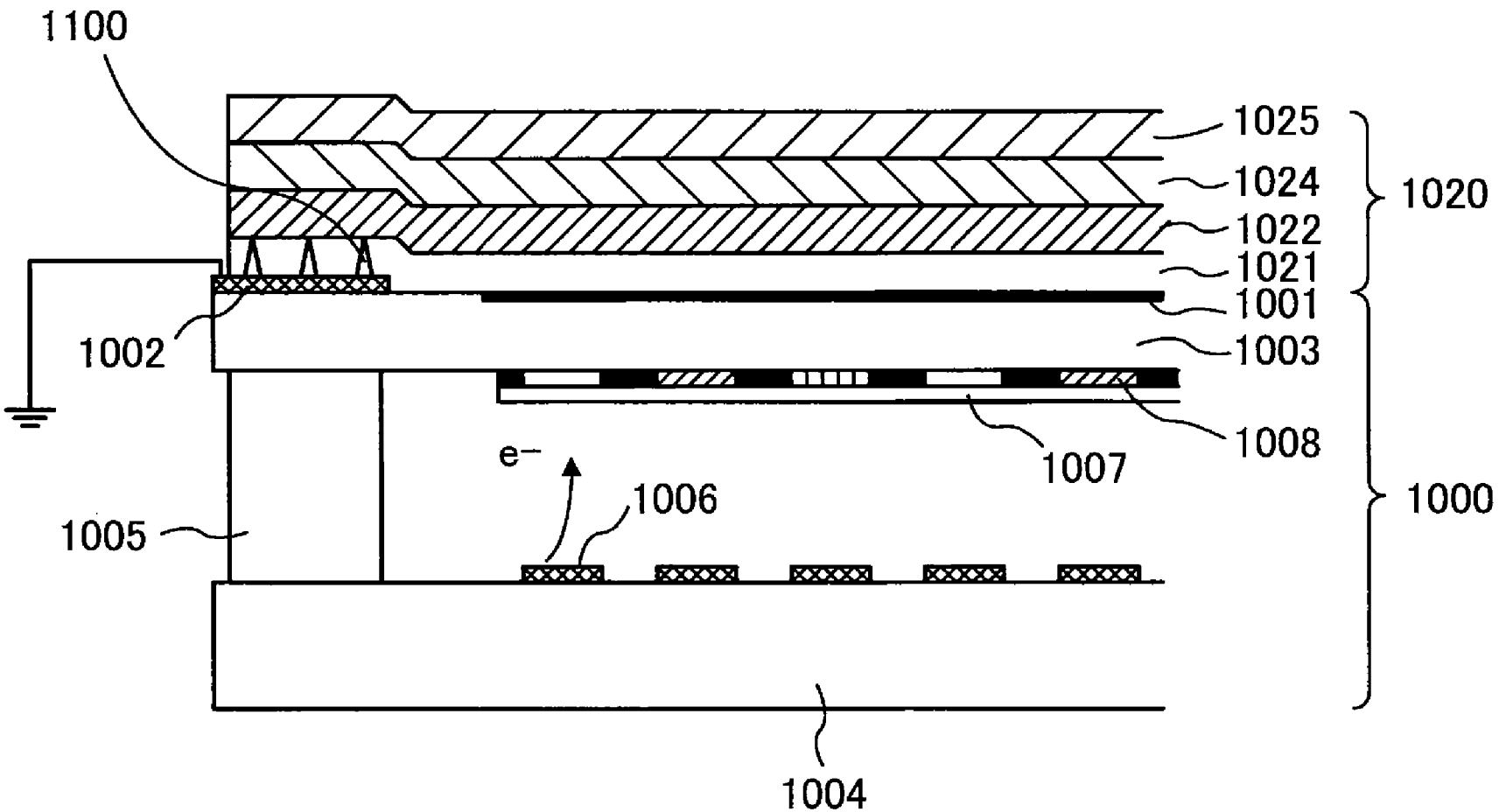
FIG. 3 is a pattern diagram observing a periphery portion of the image display apparatus according to a second embodiment of the present invention.

FIG. 3 is a pattern diagram observing a periphery portion of the image display apparatus according to a second embodiment of the present invention. Also in the image display apparatus shown in FIG. 3, the same members as those illustrated with reference to FIG. 2 are given the same reference numerals.

The basis configuration is based on the configuration illustrated in the first embodiment, however, according to the present embodiment, the electrode 1002 is changed so as to be provided with many projection portions 1100 on its surface. The height of the projection portion 1100 (a height from the base portion of the electrode 1002) is determined so as to be not less than the thickness of the adhesive layer 1021 of the functional film 1020. In other words, the height of the projection portion 1100 is determined to be about equal to the thickness of the adhesive layer 1021 or higher than this. Specifically, the height of the projection portion 1100 is determined in the range of 20 μm to 250 μm. In addition, the gaps between the projection portions 1100 are determined to be in the range of 1 mm to 20 mm.

When manufacturing the image display apparatus according to the present embodiment, at first, the electrode 1002 having the projection portions 1100 is disposed on at least a part of the area except for the image display area 1001 on the outer surface of the second substrate 1003. Further, while the adhesive layer 1021 is opposed to the second substrate 1003, a film having the conductive layer 1022 provided with the adhesive layer 1021 is positioned on the substrate 1003 so that the conductive layer 1022 is located on the image display area 1001 and at least a part of the electrode 1002. After that, the film is pressed on the second substrate 1003 so that the electrode 1002 and the conductive layer 1022 are electrically connected with each other via the projection portions 1100.

According to the image display apparatus that is configured in this way, it is possible to establish a reliable electric connection between the electrode 1002 and the conductive layer 1022 because the projection portion 1100 of the electrode 1002 breaks through the adhesive layer 1021 of the film 1020 when pressing the film against the second substrate 1003 and the projection portion 1100 contacts the conductive layer 1022. Further, an adhesive force of the adhesive layer 1021 is kept on the part other than the projection portion 1100 of the electrode 1002 and the adhesive layer 1021 makes the conductive layer 1022 and the electrode 1002 stick together. Thereby, it is possible to stably define a potential of the conductive layer 1022 of the film for a long period of time. In addition, according to the present embodiment, it takes a shorter time till the potential reaches to a stable potential (substantially, a ground potential (0V)) than the first embodiment.

It is obvious that the height and the gap of the projection portion 1100 or the like can be accordingly selected not only depending on a numeric value of the present embodiment but also depending on the maximum allowable reaching potential of the surface, a relaxation time till the potential of the surface are stabilized, or the like.

Third Embodiment

Next, the image display apparatus according to a third embodiment of the present invention will be described.

Figure 4:
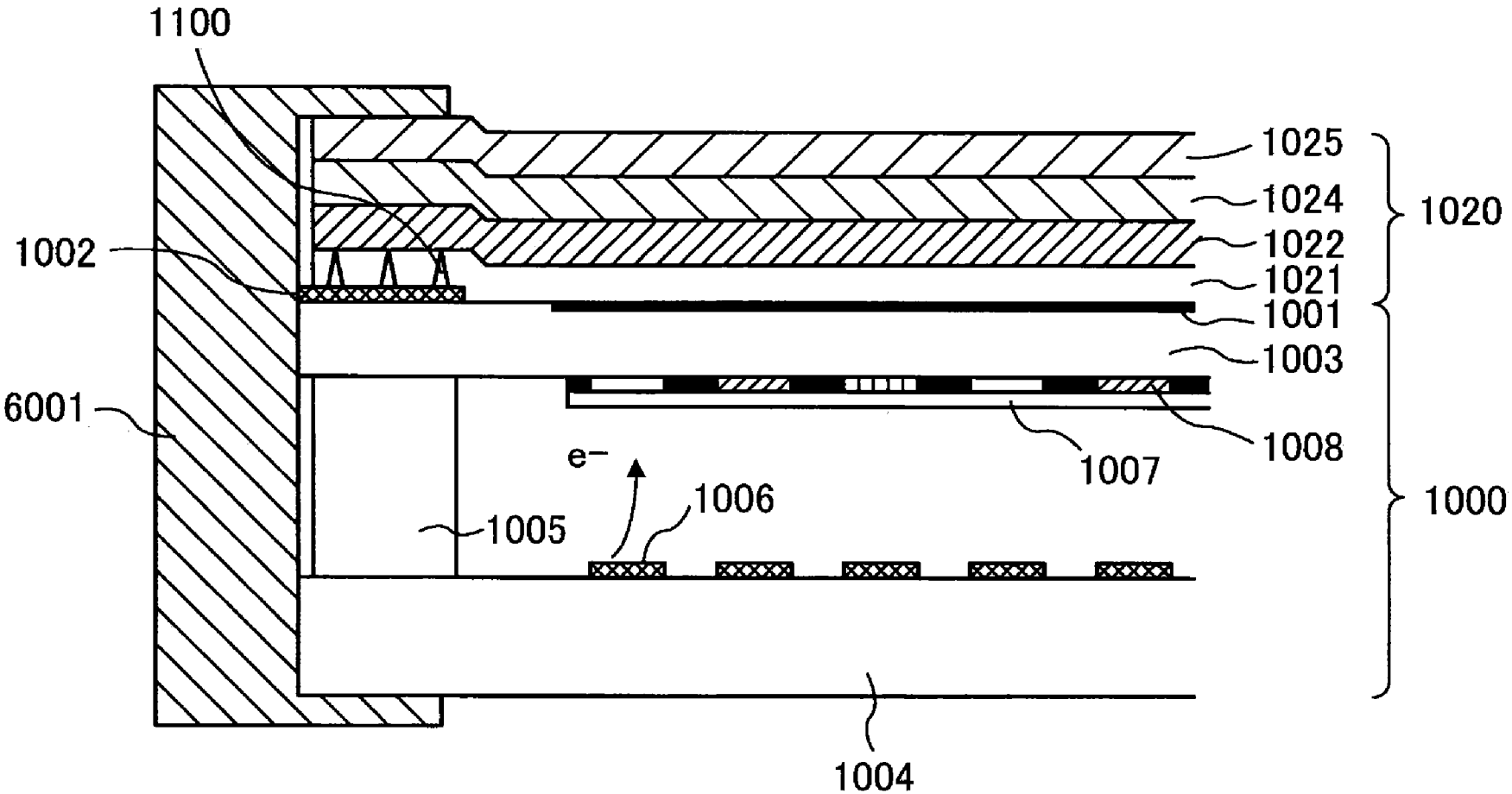
FIG. 4 is a pattern diagram observing a periphery portion of the image display apparatus according to a third embodiment of the present invention.

FIG. 4 is a pattern diagram observing a periphery portion of the image display apparatus according to the third embodiment of the present invention. Also in the image display apparatus shown in FIG. 4, the same members as those illustrated with reference to FIG. 2 and FIG. 3 are given the same reference numerals.

The basis configuration is based on the configuration illustrated in the first embodiment and the second embodiment, however, according to the present embodiment, a holding member 6001 for holding the film 1020 against the display unit 1000 is provided. The holding member 6001 also can configure a part of a case for retaining the display unit 1000.

The holding member 6001 according to the present embodiment is configured so as to sandwich the areas of the display unit 1000 and the film 1020 where the electrode 1002 having the projection portions 1100 exists. Due to this holding member 6001, the projection portion 1100 of the electrode 1002 contacts the conductive layer 1022 more reliably breaking through the adhesive layer 1021 of the film 1020. Therefore, as compared to the second embodiment, it becomes possible to establish an electric connection between the electrode 1002 and the conductive layer 1022 of the functional film 1020 more reliably, so that it is possible to stably define a potential of the conductive layer 1022 of the film for a long period of time.

According to the present embodiment, the holding member 6001 is configured so as to sandwich the areas of the display unit 1000 and the film 1020 where the electrode 1002 having the projection portion 1100 exists, however, the configuration of the holding member 6001 is not necessarily limited to this configuration. If the holding member 6001 has the configuration that can make a pressure provided on a portion where the electrode 1002 and the functional film 1020 are superimposed stronger, the same advantage can be obtained.

Fourth Embodiment

Next, the image display apparatus according to the fourth embodiment of the present invention will be described.

Figure 5:
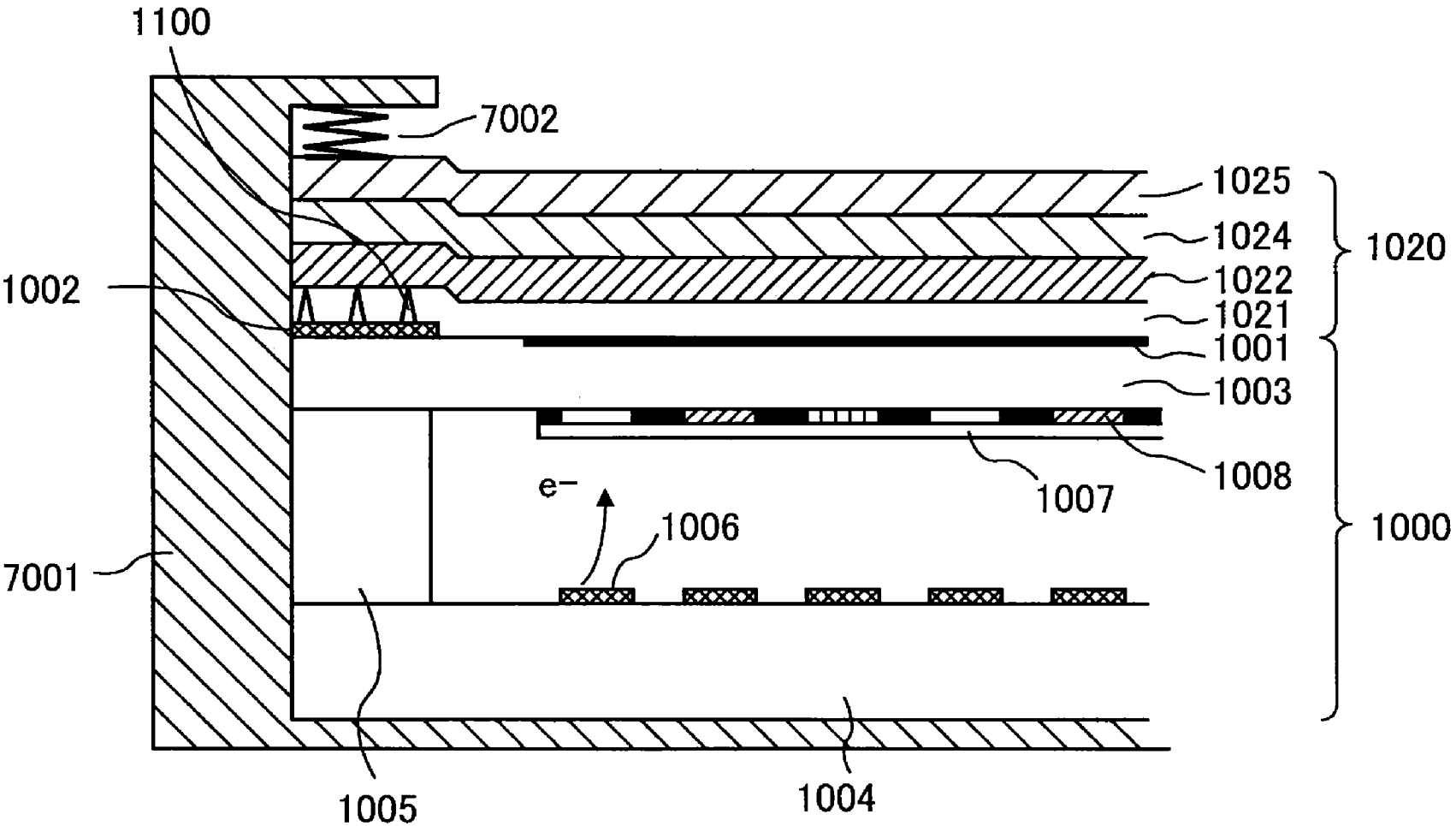
FIG. 5 is a pattern diagram observing a periphery portion of the image display apparatus according to a fourth embodiment of the present invention.

FIG. 5 is a pattern diagram observing a periphery portion of the image display apparatus according to a fourth embodiment of the present invention. Also in the image display apparatus shown in FIG. 5, the same members as those illustrated with reference to FIG. 2, FIG. 3, and FIG. 4 are given the same reference numerals.

The basis configuration is based on the configuration illustrated in the third embodiment, however, according to the present embodiment, in place of the holding member 6001 according to the third embodiment, a case 7001 supporting and involving the image display apparatus is used. As shown in FIG. 5, on the outside of the image area of the image display apparatus, namely, on the portion located just above the electrode 1002 of the film 1020 (a portion where the film 1020 and the electrode 1002 are superimposed) in the case 7001 covering a frame portion, an elastic member 7002 is disposed. Due to this elastic member 7002, the present embodiment is configured so that the film 1020 is held by the display unit 1000 (the second substrate 1003).

According to the present embodiment, as the elastic member 7002, a coil-shaped spring is used. The elastic member 7002 is not limited to this but a plate-like spring and a rubber or the like may be used. Alternatively, assuming that the portion itself of the case 7001 located just above the electrode 1002 of the film 1020 has elasticity, there is no necessity to use the elastic member 7002 separately.

Due to the above-described configuration, it is possible to make the electrode 1002 and the conductive layer 1022 of the functional film 1020 stick together with a stronger pressure, so that it is possible to stably define a potential of the conductive layer 1022 of the functional film for a long period of time as in the third embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-229664, filed on Aug. 25, 2006, which is hereby incorporated by reference herein in its entirety.

What is claimed is:

1. An image display apparatus comprising:

a display unit including a substrate having an outer surface and an image display area, a conductive layer disposed on the substrate via an adhesive layer;

a conductive tape disposed on the outer surface of the substrate; and a member for holding the conductive layer against the substrate, wherein part of the adhesive layer is layered between the conductive tape and at least a part of the conductive layer, the conductive tape includes a projection portion contacting the conductive layer such that the conductive layer and the conductive tape are electrically connected, the member sandwiches the conductive layer, the conductive tape having the projection portion, and the display unit; and the conductive tape is a ground potential.

2. An image display apparatus according to claim 1, wherein the display unit is any one of an electron beam display unit, a plasma display unit, a liquid crystal display unit, and an electro-luminescent display unit.

3. An image display apparatus comprising:

a display unit including a substrate having an outer surface and an image display area;

a conductive layer disposed on the substrate via an adhesive layer;

a conductive tape disposed on the outer surface of the substrate; and a member for holding the conductive layer against the substrate, wherein part of the adhesive layer is layered between the conductive tape and at least a part of the conductive layer, the conductive tape includes a projection portion contacting a side of the conductive layer such that the conductive layer and the conductive tape are electrically connected, the member sandwiches the display unit, the conductive layer, and the conductive tape having the projection, and the member includes an elastic member disposed above the conductive tape, and the conductive tape is a ground potential.

4. An image display apparatus according to claim 1, wherein the conductive tape encircles the image display area on the display unit.

5. An image display apparatus according to claim 1, wherein the projection portion of the conductive tape projects through the adhesive layer to contact the conductive layer.

6. An image display apparatus according to claim 3, wherein the display unit is any one of an electron beam display unit, a plasma display unit, a liquid crystal display unit, and an electro-luminescent display unit.

7. An image display apparatus according to claim 3, wherein the conductive tape encircles the image display area on the display unit.

8. An image display apparatus according to claim 3, wherein the projection portion of the conductive tape projects through the adhesive layer to contact the conductive layer.

* * * * *